US006573667B2

(12) United States Patent
Van Gurchom

(10) Patent No.: US 6,573,667 B2
(45) Date of Patent: Jun. 3, 2003

(54) CONNECTING SOCKET AND DEVICE FOR MATCHING OF A PICTURE TUBE

(75) Inventor: Adrianus Henricus Martinus Van Gurchom, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/011,614

(22) Filed: Dec. 6, 2001

(65) Prior Publication Data

US 2002/0075417 A1 Jun. 20, 2002

(30) Foreign Application Priority Data

Dec. 13, 2000 (EP) ..... 00204487

(51) Int. Cl.[7] ..... G09G 1/04
(52) U.S. Cl. ..... 315/366; 313/318.01
(58) Field of Search ..... 315/366, 370, 315/371; 348/190, 189, 191, 86; 313/318.01, 318.12

(56) References Cited

U.S. PATENT DOCUMENTS 5,986,696 A * 11/1999 Shin ..... 348/190
6,094,002 A * 7/2000 Bae et al. ..... 313/318.01

FOREIGN PATENT DOCUMENTS

GB 2326973 1/1999 ..... H01J/9/42

* cited by examiner

*Primary Examiner*—Hoang Nguyen

(57) ABSTRACT

The present invention relates to a device for matching of a picture tube, comprising a product carrier arranged to carry the picture tube along a matching line to a matching position, said carrier being connected to a voltage source, and a matching means, located in the matching position for performing the matching of the tube. The device further includes a connecting socket, adapted to be mounted onto and electrically connected to said picture tube base connector. The connecting socket comprises a first terminal for connection of the cathode pre heating filament to said voltage supply via the carrier, and a plurality of second terminals for separate, simultaneous connection of said matching means directly to said socket.

Figure 1:
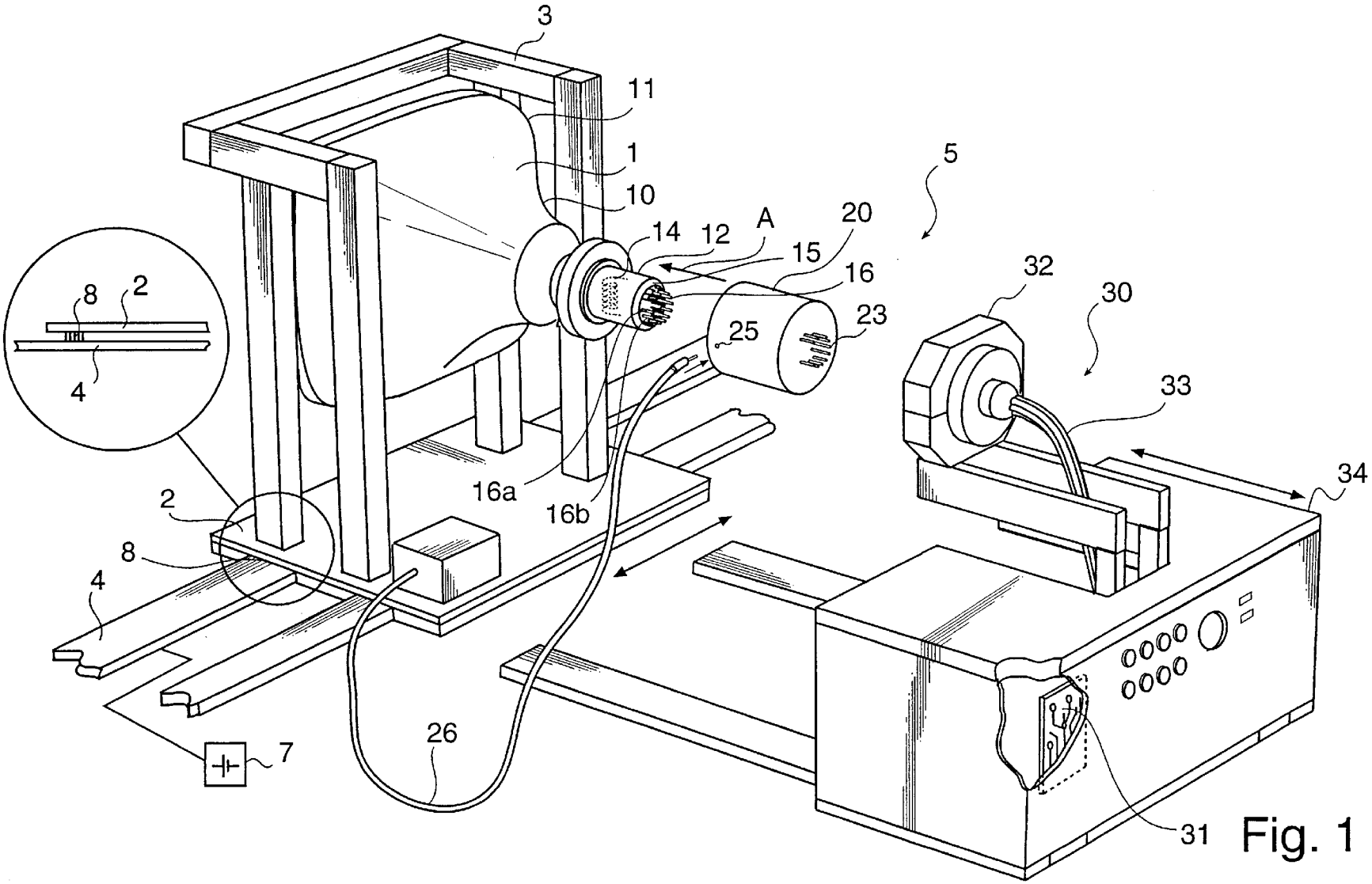

With the invention, the need for long wiring between the base connector and the carrier is eliminated, and the carrier is simplified.

16 Claims, 3 Drawing Sheets

CONNECTING SOCKET AND DEVICE FOR MATCHING OF A PICTURE TUBE

The present invention relates to a device for matching of a picture tube, said picture tube having a base connector comprising a plurality of electrical terminals, one of which is connected to means for preheating of a cathode in the picture tube, said device comprising a product carrier arranged to carry said picture tube along a matching line to a matching position, said carrier being connected to a voltage source, and a matching means, located in the matching position for performing the matching of the tube.

The invention also relates to a connecting socket, intended to be mounted onto and electrically connected to a picture tube base connector.

In a matching process for picture tubes (CRT), the tubes are preheated for a period of 30 minutes, followed by the adjustment of the deflection unit. During the preheating, a filament in the tube is connected to a heater voltage, and during the matching, the tube connected to several control voltages.

When picture tubes are matched in a production line, product carriers are normally used for transporting the tubes, and each carrier is connected to a heating voltage source via the transportation line. The tube is electrically connected to a connecting device on the carrier by several wires, one of which secures pre heating of the tube during transportation in the line. When the carrier stops in a working position, a measuring instrument is automatically connected to the connecting device. A device of this kind, where the measuring instrument is connected from the side, is disclosed in GB 2326973. Another way to accomplish the connection is to provide the connecting device on under side of the carrier, and the terminal unit of the measuring instrument is connected from underneath.

A problem with this type of connection arrangement is the need for relatively long (several decimeters) wires between the picture tube and the connecting device on the carrier. The long wiring makes it difficult to achieve a high quality signal when high frequencies are used for the matching process, and for frequencies above 60 kHz the problems with deterioration of picture quality are significant.

Another drawback is the fact that the connection of the control wiring to the tube base has to be provided on every product carrier, normally more than one hundred in a manufacturing plant.

The connector in the picture tube base comprises several parallel connection pins, and known connectors are arranged to connect to all these pins at the same time. Therefore, in order to connect the terminal unit of the measuring instrument directly to the picture tube in the matching position, the connection for the preheating voltage would have to be removed to allow for connection of the terminal unit.

An object of the present invention is thus to overcome these problems, and to provide a device for matching a CRT without the need for excessively long wires.

A second object is to provide an improved device for connecting a heating voltage to a picture tube during matching.

These objects are accomplished by a connecting socket, adapted to be mounted onto and electrically connected to said picture tube base connector, which connecting socket comprises a first terminal for connection of said filament to said voltage supply via the carrier, and a plurality of second terminals for separate, simultaneous connection of said matching means directly to said socket.

The connecting socket, intermediate between the base connector and the matching means, is adapted to connect the heating voltage to the filament of the tube, while still permitting the direct connection of the control voltages. The term "direct" is here understood to mean that no intermediate wires are needed. Thus it is possible to connect the matching means directly to the tube, eliminating the need for long wires.

The intermediate socket thus makes it possible to keep the preheating voltage connected to the filament as long as the tube is placed on the pallet, while the control voltage connections are made directly to the tube in the matching position.

According to prior art, as was described above, the connection of the control voltages were made in two steps: First, a multi-wire connection was provided between the base connector and the carrier, thereby allowing for connection of the heating voltage. Then, a connecting device on the carrier was connected directly to the matching means.

As the intermediate socket according to the invention only needs one connection (the heating voltage), the connection between the picture tube and the product carrier is simplified. Instead of comprising wiring to all the control voltages, there is only one wire, and this wire only connects a low voltage (the heating voltage is typically under 10 V). This means that maintenance of the product carriers (around 100 in a normal manufacturing plant) is facilitated. A complete tube base connection is only required in the match positions, and not on every product carrier all the time.

The plurality of second terminals can consist of parallel connecting elements, similar to the ones present in a conventional picture tube base connector. Preferably the plurality of second terminals are connectable to a connector initially intended for connection with a picture tube base connector. This makes it possible to use the connecting socket in existing installations with very little adjustment.

A second aspect of the invention relates to a device for matching of a picture tube, comprising such a connecting socket. Preferably, the matching means is directly engageable/disengageable with said connecting socket without disconnecting the heating voltage. This results in a simple procedure for connecting the matching means.

In a preferred embodiment, the matching means comprises a connector portion, which is transversely movable to engage with said connecting socket mounted on a picture tube. This enables easy operation at the matching position.

The connecting socket can be connected to the carrier with the means of a wire, supplying the connecting socket with voltage for the preheating means.

These and other aspects of the invention will be apparent from the following description of a presently preferred and non-restrictive embodiment, where reference is made to the accompanying drawings.

FIG. 1 is an explosion view of a device according to an embodiment of the invention.

Figure 2A:
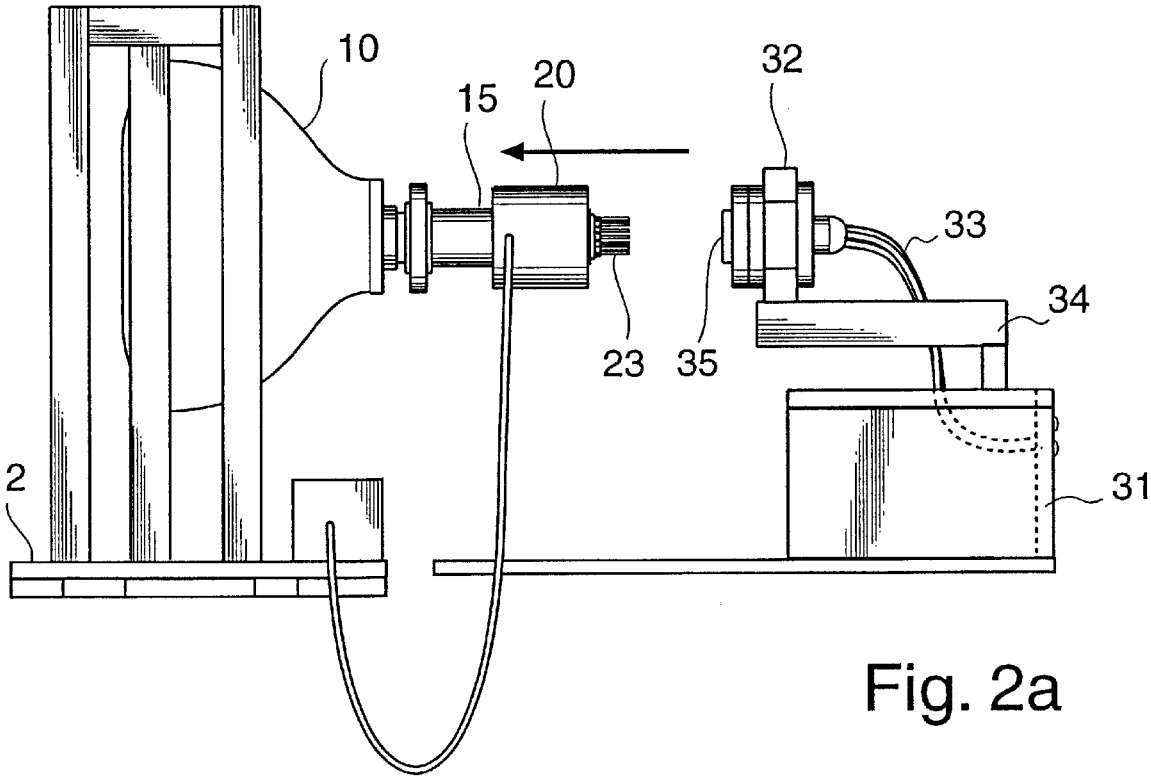
Figure 2B:
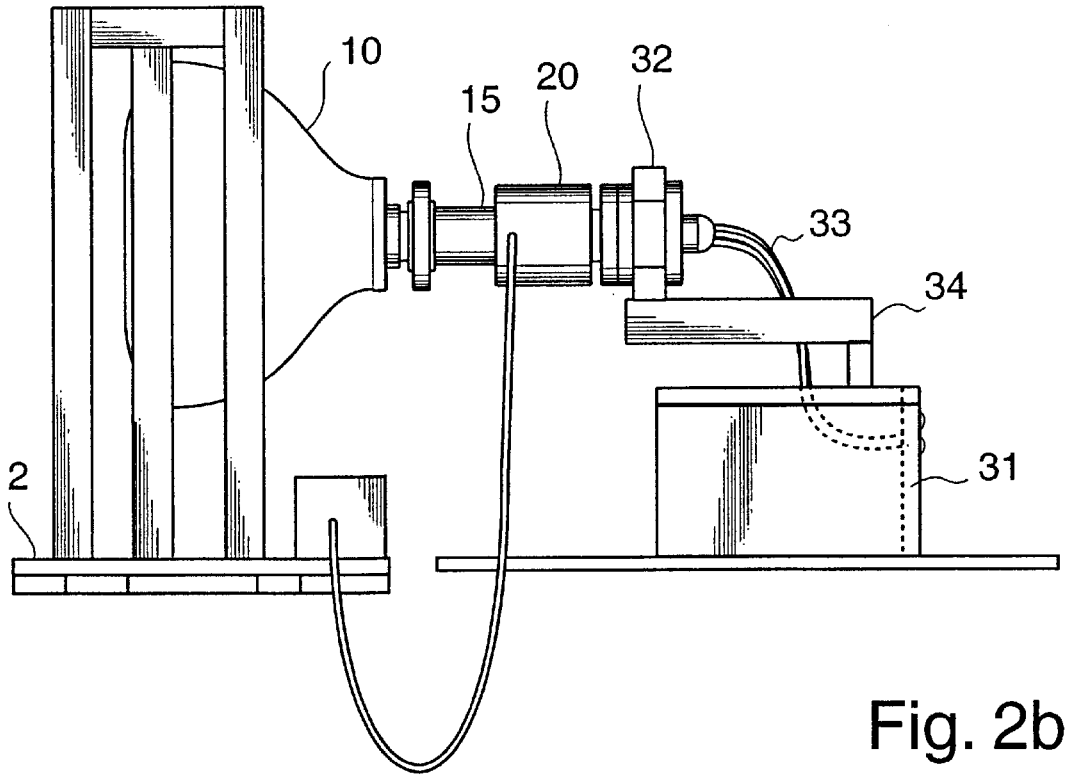

FIGS. 2*a* and 2*b* are side views of the device in FIG. 1 in disconnected and connected state respectively.

Figure 3:
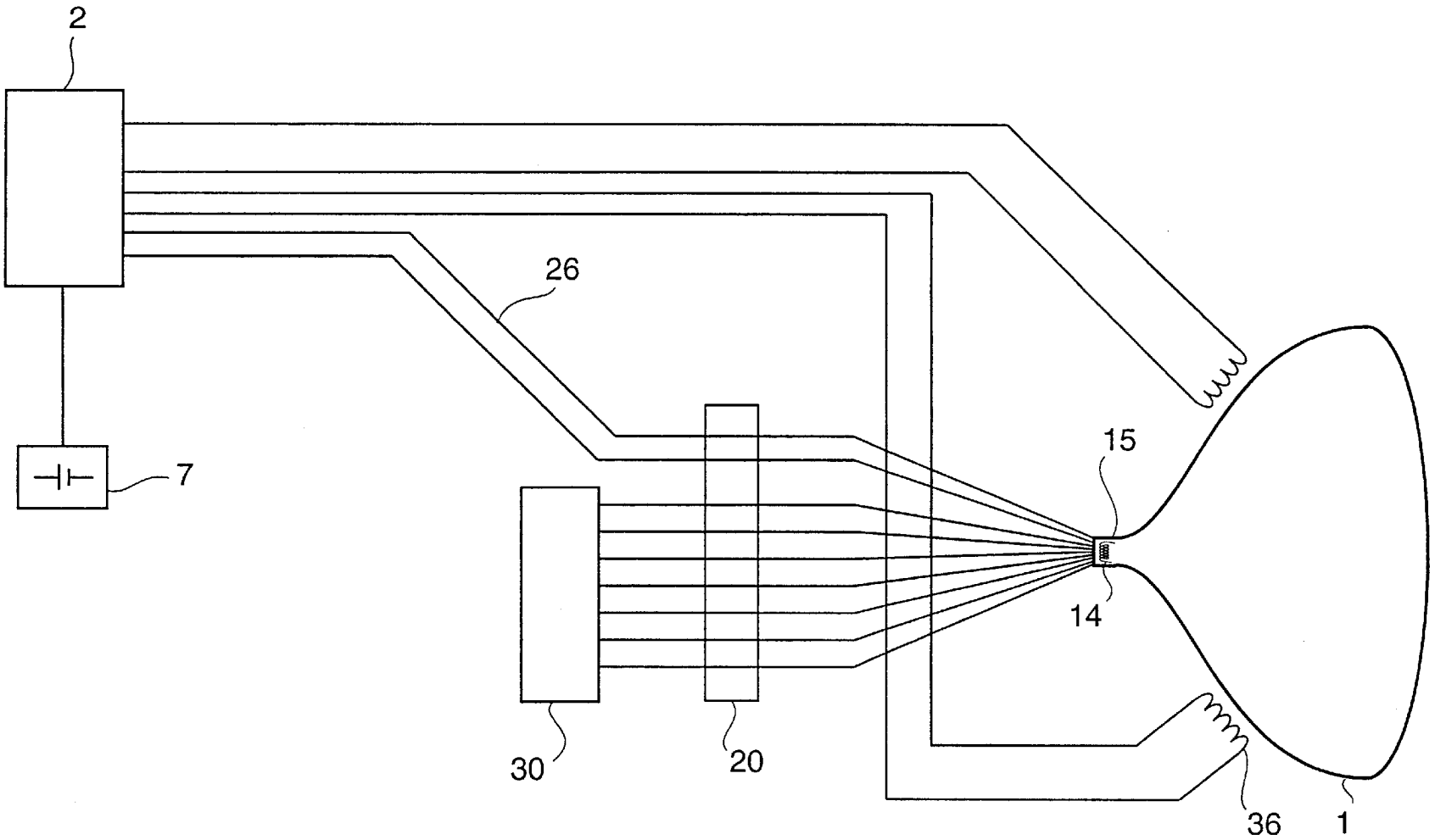

FIG. 3 is a schematic illustration of how a CRT is connected to the measurement voltages and to the heating filament.

The CRT 1 shown in FIG. 1 is arranged on a product carrier 2, or a pallet. The CRT 1 is surrounded by a frame 3, serving as impact protection and stabilizing the CRT 1, which is not yet provided with a protective casing. The pallet 2 is arranged to be transported along a transportation line 4, passing different control positions, including a matching position 5, where a matching means 30 is arranged to perform a matching of the CRT 1. The pallet 2 is connected to a voltage supply 7 with the use of brushes 8 or the like, securing voltage supply to the pallet 2 as it is transported along the line 3.

The CRT 1 comprises a picture display tube 10 with a front portion having a truncated cone 11 and a back portion in the form of a cylindrical neck 12. The rear part of the neck accommodates several, normally three (red, blue and green), electron guns (not shown), with accompanying wiring (not shown). The wiring includes lines for grid and focus voltages (Vg1, Vg2, Vg3*a*, Vg3*b*), and cathode voltages (Kg, Kb, Kr). The neck also accommodates a heating filament 14 for heating the cathodes, and wiring for connecting the filament 14 to a heating voltage (Vf).

The wires lead to a base connector 15, arranged at the end of the neck portion 12, where each wire is connected to a terminal in the form of a pin 16. All terminal pins 16 are arranged in parallel next to each other in a substantially circular pattern. The pins connecting the focus voltage, which is typically in the order of 6 kV, are normally encompassed by a protective edge. Due to this configuration, any connection of the base connector 15 has to be performed with a transversal motion in a direction A parallel to the extension of the pins 16.

In FIG. 1, a connecting socket 20 essentially in the form of a cylinder is shown. The socket 20 is connected to the base connector 15, and provides an intermediate connection allowing for permanent connection of a heating voltage (Vf) from the pallet 2, while at the same time allowing a subsequent direct connection of a matching means 30. In the illustrated example, where the base connector 15 comprises a number of terminal pins 16, the intermediate socket 20 comprises on a first side a first set of connectors (hidden in FIG. 1) establishing electrical contact with several, preferably all of these terminal pins 16, and on the second side comprises an auxiliary set of terminal pins 23 corresponding to at least some of the pins 16 in the base connection, to which the matching means 30 can be connected. However, the terminal pins 16*a*, 16*b* of the filament 14 are not connected to an auxiliary terminal pin, but instead are connected to a separate terminal 25, in turn connected the pallet 2 with a wire 26, which separately connects the filament 14 with the heating voltage (Vf) available on the pallet 2. This wire for connecting the heating voltage is the only connection between the picture tube base connector 15 and the pallet 2.

On the socket 20 shown in FIG. 1, the number of terminal pins 23 on the second side, i.e. the side facing the matching means, is provided with two fewer terminal pins than the base connector of the picture tube, as the two terminals 16*a*, 16*b* used for connecting the filament are not needed any more, as they are separately connected. However, the number of terminals on this side of the socket may be even fewer, for example in a case where other tests are to be performed, or greater, allowing for the socket to provide exactly the same connections as the base connector on the picture tube.

To the right of the intermediate socket 20 in FIG. 1 is a matching means 30, which is located in the matching position 5 along the transportation line 3. The matching means 30 comprises circuitry 31, known par se, for analyzing the response from the picture tube 1 to signals applied to the voltage connections 16 in the base connector 15. This circuitry 31 is connected to a connector 32 by means of wires 33, and the connector 32 is arranged to be movable towards an intermediate socket 20 mounted on the base connector 15 of a picture tube 1 carried by a pallet 2 stopping in the matching position 5. In the illustrated example, the whole matching means 30, i.e. the circuitry 31 as well as the connector 32 and wiring 33, is mounted on a carriage 34 that is slidable towards the pallet 2 and a picture tube 1 carried thereon. FIG. 2*a* shows the carriage in a first position, where the connector 32 is located at a distance from the intermediate socket 20, and FIG. 2*b* shows the carriage 34 in a second position, where the connector 32 is engaged with the socket 20.

The connector 32 comprises a plurality of connection terminals 35 arranged to engage with the terminals 23 of the intermediate socket 20. Preferably, the terminals 23 on the intermediate socket have the same dimensions as the terminal pins 16 on the base connector 15 of the CRT 1. Thus, the connector 31 of the matching means 32 can be a conventional connector, used in prior art. The carriage can be automatically controlled in a way similar to that showed in GB 2326973, hereby incorporated by reference.

An important feature of the intermediate socket is thus that it connects the heating voltage to the signal lines, and at the same time allows for connection of the measurement voltages through a simple movement of the matching means.

The basic idea of the invention is clear from FIG. 3, which illustrates how the matching unit 30 is connected to the picture tube 1, in this case with seven lines (G1, G2, G3*a*, G3*b*, Kg, Kr, Kb). The intermediate socket 20 is indicated by a rectangular box, having nine connections to the CRT base connector 15, and seven connections to the matching unit 30. The two remaining leads (for connection of the heating filament 14) are connected separately with wire 26 from the socket 20 to the voltage supply 7 via the pallet 2. The two electron beam deflection coils 36 of the CRT 1 are also connected to the pallet 2 using four contacts on a contact block (not shown).

Many variations deviations from the above description of a preferred embodiment may be performed by the man skilled in the art, without departing from the scope of the appended claims. The important inventive idea is considered to consist of an intermediate coupling between the base connector 15 and the matching unit 30, in order to allow for separate connection of the heating voltage (Vf), while still permitting direct connection of the matching unit 30.

What is claimed is:

1. A device for matching of a picture tube, said picture tube having a base connector comprising a plurality of electrical terminals, one of which is connected to means for preheating of a cathode in the picture tube, said device including a product carrier arranged to carry said picture tube along a matching line to a matching position, said carrier being connected to a voltage source, and a matching means, located in the matching position for performing the matching of the tube, characterized by a connecting socket, adapted to be mounted onto and electrically connected to said picture tube base connector, which connecting socket comprises a first terminal for connection of said preheating means to said voltage supply via the carrier, and a plurality of second terminals for separate, simultaneous connection of said matching means directly to said socket.

2. Device according to claim 1, wherein said matching means is directly engageable with said connecting socket without disconnecting the heating voltage.

3. Device according to claim 2, wherein said connecting socket is connected to the carrier with the means of a wire, supplying the connecting socket with voltage for the preheating means.

4. Device according to claim 2, wherein said matching means is connectable to said socket without any intermediate wiring.

5. Device according to claim 1, wherein said matching means is connectable to said socket without any intermediate wiring.

6. Device according to claim 5, wherein said matching means comprises a connector portion, which is transversely movable to engage with said connecting socket mounted on a picture tube.

7. Device according to claim 6, wherein said connecting socket is connected to the carrier with the means of a wire, supplying the connecting socket with voltage for the preheating means.

8. Device according to claim 5, wherein said connecting socket is connected to the carrier with the means of a wire, supplying the connecting socket with voltage for the preheating means.

9. Device according to claim 1, wherein said connecting socket is connected to the carrier with the means of a wire, supplying the connecting socket with voltage for the preheating means.

10. A connecting socket configured for mounting onto and electrically connecting to a picture tube base connector, said connecting socket comprising a first terminal for connection of a first voltage, and a plurality of second terminals for simultaneous connection of a plurality of second voltages.

11. Connecting socket according to claim 10, said second terminals consisting of parallel connecting elements.

12. Connecting socket according to claim 11, having a substantially cylindrical shape.

13. Connecting socket according to claim 11, wherein said plurality of second terminals are connectable to a connector intended for connection with said base connector.

14. Connecting socket according to claim 10, having a substantially cylindrical shape.

15. Connecting socket according to claim 14, wherein said plurality of second terminals are connectable to a connector intended for connection with said base connector.

16. Connecting socket according to claim 10, wherein said plurality of second terminals are connectable to a connector intended for connection with said base connector.

* * * * *